US005664670A

United States Patent [19]

Cozzie

[11] Patent Number: 5,664,670

[45] Date of Patent: Sep. 9, 1997

[54] POWDERED DRINK MULTIPLE COMPARTMENT FLEXIBLE PACKET

[76] Inventor: Robert Cozzie, 20 N. Ocean Ave., Ronkonkoma, N.Y. 11779

[21] Appl. No.: 617,080

[22] Filed: Mar. 18, 1996

[51] Int. Cl.[6] ..... B65D 75/00

[52] U.S. Cl. ..... 206/216; 426/115; 426/119

[58] Field of Search ..... 206/216, 217, 206/484; 426/112, 115, 119, 120, 123

[56] References Cited

U.S. PATENT DOCUMENTS

| | | | |
|---|---|---|---|
| 2,457,924 | 1/1949 | Salfisberg | 206/484 X |
| 2,794,545 | 6/1957 | Olson | 206/217 |
| 3,469,768 | 9/1969 | Repko | 206/484 X |
| 5,132,124 | 7/1992 | Tamaki et al. . | |
| 5,406,278 | 4/1995 | Beer . | |
| 5,422,129 | 6/1995 | Draddy . | |
| 5,447,236 | 9/1995 | Perry et al. . | |

*Primary Examiner*—Jacob K. Ackun
*Attorney, Agent, or Firm*—Michael I. Kroll

[57] ABSTRACT

A powdered drink multiple compartment flexible packet (10) comprising a rear rectangular panel (12) and a front rectangular panel (14). A first facility (16) is for connecting side edges (18), top edges (20) and bottom edges (22) of the rear rectangular panel (12) to the front rectangular panel (14). A second facility (24) is for connecting intermediate spaced apart strips (26) of the front rectangular panel (14) to the rear rectangular panel (12). The strips (26) are in parallel relationships to the top edges (20) and the bottom edges (22) thereof, so as to form a plurality of compartments (28) therein to separately hold particulate ingredients (30) needed in making the powdered drink.

1 Claim, 3 Drawing Sheets

Fig. 3
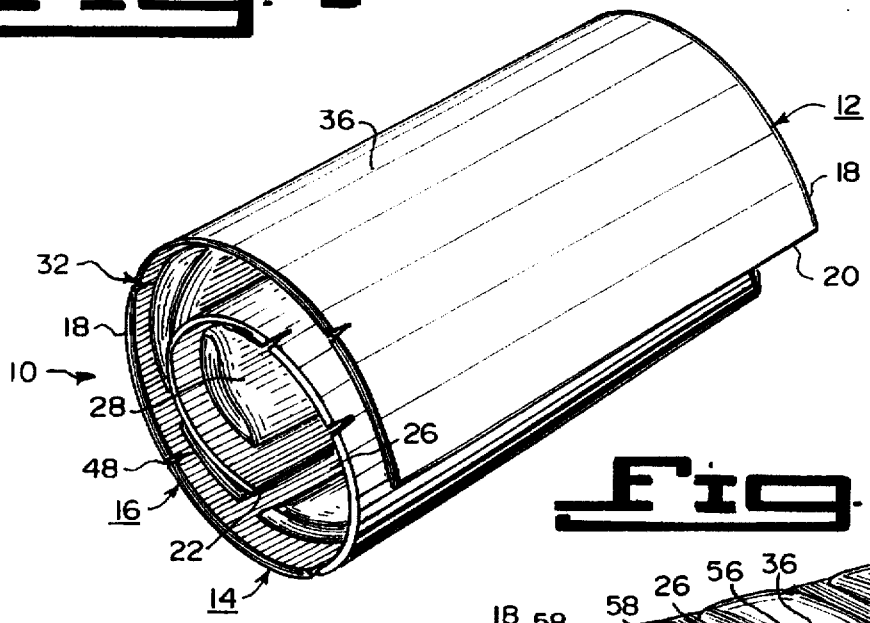
Fig. 4
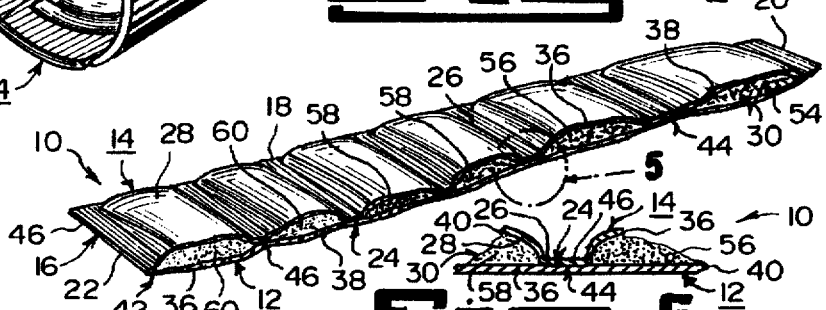
Fig. 5
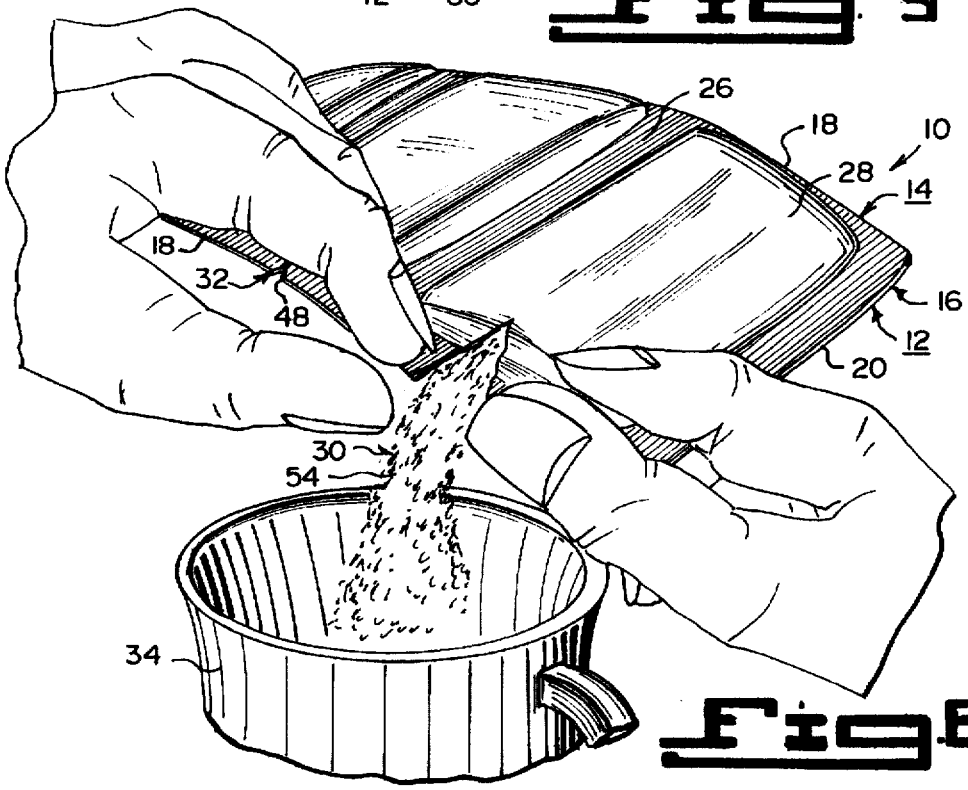
Fig. 6

POWDERED DRINK MULTIPLE COMPARTMENT FLEXIBLE PACKET

BACKGROUND OF THE INVENTION

1. Field of the Invention

The instant invention relates generally to food containers and more specifically it relates to a powdered drink multiple compartment flexible packet.

2. Description of the Prior Art

Numerous food containers have been provided in prior art. For example, U.S. Pat. Nos. 5,132,124 to Tamaki et al.; 5,407,278 to Beer; 5,422,129 to Draddy and 5,447,236 to Perry et al. all are illustrative of such prior art. While these units may be suitable for the particular purpose to which they address, they would not be as suitable for the purposes of the present invention as heretofore described.

A powdered drink brewing bag comprising a filter paper bag body having gusset walls and containing a powdered material, such as coffee powder therein. A frame type support member formed of thick paper is bonded to opposing walls of the bag body in the vicinity of the upper edge thereof in such a manner that the bag body is held at both surfaces thereof between the opposite surfaces of the support member. Arm portions project outwardly from the portions of the support member which correspond to both sides of the filter paper bag body, and are provided with folds and handles so that the arm portions are bent in the shape of the letter "Y" in plan to enable the gusset walls to be expanded. Accordingly, the upper edge portion of the bag body can be maintained in a largely opened state, so that the hot water can be poured thereinto easily, and a drink, such as coffee, to be obtained conveniently.

Flexible packages, each having a hollow interior including a pair of compartments for holding respective granular or powdered products isolated from each other. The packages are formed of flexible sheet material and comprises a front panel, a rear panel, and an intermediate panel. The front and rear panels each have a top edge portion, a bottom edge portion, and a pair of sides which are connected together. The bottom edge portions of the front and rear panels are sealed together. The intermediate panel has a pair of side edges and a bottom edge portion, with one of the sides edges sealed to the package along one of the sides, and the other of the side edges is peelably sealed to the rear panel in one embodiment and to the front panel in another embodiment. The top edge portion of the intermediate panel is permanently sealed to the top edge portion of one panel and is peelably sealed to the top edge portion of the other panel. The bottom edge portion of the intermediate panel is permanently sealed to the front and rear panels. The space between the intermediate panel and the panel to which is peelably secured forms one compartment and the space between the intermediate panel and the other panel from the other compartment. A hand peelable seal extends across the top portion of the panels to releasably seal the materials within the compartments and to enable the package to be readily peeled open to simultaneously pour the contents of the compartments therefrom.

A dispensing display container of coffee or other spoonable particulate foodstuff comprises an upper, externally threaded cylinder and an internally threaded sleeve that the user discards when empty.

A multiple compartment package for use in the packaging of foodstuff articles includes a first compartment portion, a second compartment portion, and a retaining mechanism for retaining the first compartment portion in close relation to the second compartment portion.

SUMMARY OF THE INVENTION

A primary object of the present invention is to provide a powdered drink multiple compartment flexible packet that will overcome the shortcomings of the prior art devices.

Another object is to provide a powdered drink multiple compartment flexible packet, in which the multiple compartments are sealed to hold separately the particulate ingredients needed in making the powdered drink.

An additional object is to provide a powdered drink multiple compartment flexible packet, in which each compartment includes a notch at one side, so that a person can quickly tear open the compartments to empty the particulate ingredients in any combination into a cup, to make the powdered drink to ones personal taste.

A further object is to provide a powdered drink multiple compartment flexible packet that is simple and easy to use.

A still further object is to provide a powdered drink multiple compartment flexible packet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view of the instant invention rolled up.

FIG. 4 is a cross sectional perspective view taken along line 4—4 in FIG. 2, showing the particulate ingredients in each compartment.

FIG. 5 is an enlarged cross sectional view of the area in FIG. 4 indicated by arrow 5, showing the heat seal in greater detail between two compartments.

FIG. 6 is a perspective view showing the compartment being torn open at the notch by the hands of a person and the particulate ingredients being deposited into a cup.

Similar reference characters denote corresponding features consistently throughout the attached drawings.

DETAILED DESCRIPTION OF THE PREFERRED EMBODIMENTS

Figure 1:
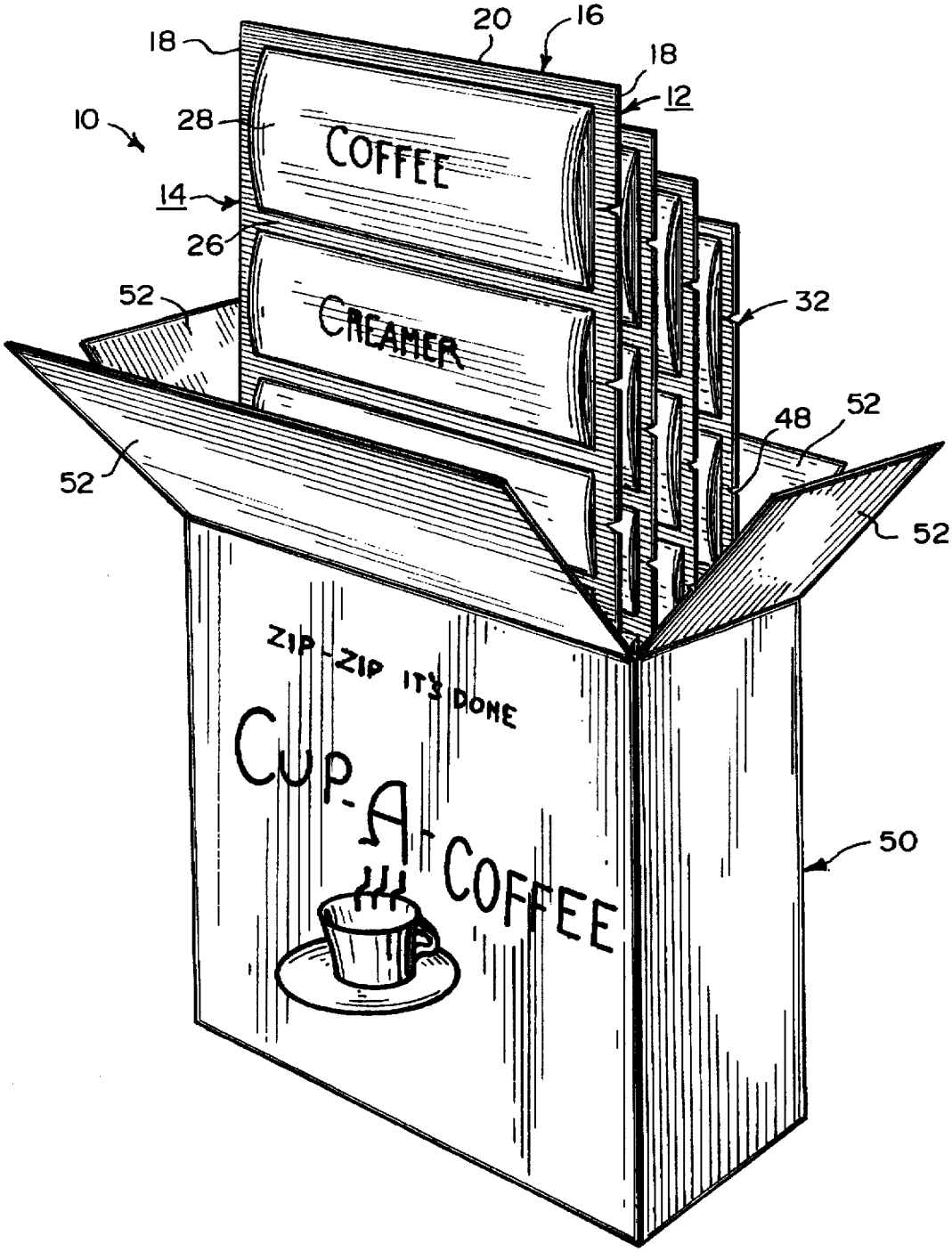
FIG. 1 is a perspective view showing the flaps of a box opened for holding a plurality of the instant invention therein.

Turning now descriptively to the drawings, in which similar reference characters denote similar elements throughout the several views, FIGS. 1 through 5 illustrate a powdered drink multiple compartment flexible packet 10 comprising a rear rectangular panel 12 and a front rectangular panel 14. A first facility 16 is for connecting side edges 18, top edges 20 and bottom edges 22 of the rear rectangular panel 12 to the front rectangular panel 14. A second facility 24 is for connecting intermediate spaced apart strips 26 of the front rectangular pane 14 to the rear rectangular panel 12. The strips 26 are in parallel relationships to the top edges 20 and the bottom edges 22 thereof, so as to form a plurality of compartments 28 therein to separately hold particulate ingredients 30 needed in making the powdered drink. One side edge 18 thereof has a means 32 for allowing a person to quickly open each compartment 28, so as to empty the particulate ingredients 30 in any combination therefrom into a cup 34, to make the powdered drink to the persons personal taste.

The rear rectangular panel 12 and the front rectangular panel 14 are each formed of a sheet of flexible material 36. Each sheet of flexible material 36 is made out of plastic 38, as shown in FIG. 4. Each sheet of flexible material 36 can also be made out of foil 40, as shown in FIG. 5.

The first connecting facility 16 is a permanent seal 42. The second connecting facility 24 is a permanent seal 44. The first permanent seal 42 is a heat seal 46. The second permanent seal 44 is also a heat seal 46.

The quickly open allowing means 32 consists of a plurality of notches 48. Each notch 48 is formed in the side edges 18 and is centrally located to one side of one compartment 28, so that each notch 48 can be torn to open the respective compartment 28 (see FIG. 6).

Figure 2:
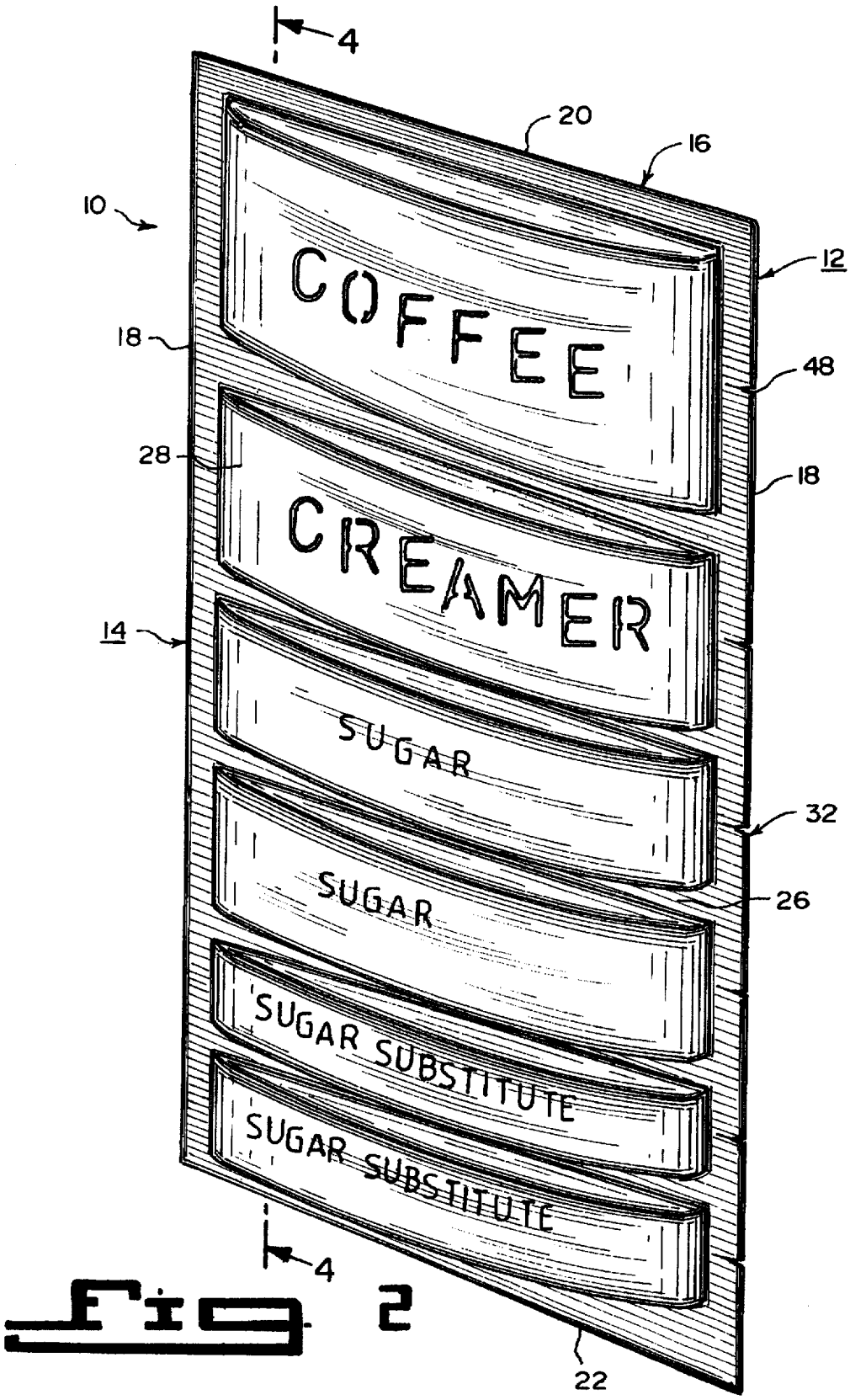
FIG. 2 is a perspective view of the instant invention per se.

As shown in FIG. 2, a box 50 is provided having a plurality of top flaps 52 which can be opened. The box 50 will hold a plurality of packets 10 therein, which can be removed one at a time to be used in making the powdered drink.

The particulate ingredients 30 can typically include a serving of coffee powder 54 carried in the first compartment 28. A serving of creamer powder 56 is carried in the second compartment 28. A serving of sugar 58 is carried in the third compartment 28, and serving of the sugar 58 is also carried in the fourth compartment 28. A serving of sugar substitute 60 is carried in the fifth compartment 28, and a serving of the sugar substitute 60 is also carried in a sixth compartment 28.

Other particulate ingredients 30 can be carried in the compartment 28. For example, tea powder, soup powder, cocoa powder, punch powder and other food powders can be used.

OPERATION OF THE INVENTION

To use the powdered drink multiple compartment flexible packet 10, the following steps should be taken:

1. Open the top flaps 52 on the box 50.
2. Remove one packet 10 from the box 50.
3. Tear the first notch 48 to open the first compartment 28.
4. Empty the coffee powder 54 into the cup 34 from the first compartment 28.
5. Tear the second notch 48 to open the second compartment 28.
6. Empty the creamer powder 56 into the cup 34 from the second compartment 28.
7. Tear one or both of the third and fourth notches 48 to open the third and fourth compartments 28.
8. Empty the sugar 58 into the cup 34 from the third and fourth compartments 28.
9. Tear one or both of the fifth and sixth notches 48, to open the fifth and sixth compartments 28.
10. Empty the sugar substitute 60 instead of the sugar 58 into the cup 34.
11. Add hot water into the cup 34, to make the powdered drink which is instant hot coffee.

LIST OF REFERENCE NUMBERS

10 powdered drink multiple compartment flexible packet
11 rear rectangular panel of 10
14 front rectangular panel of 10
16 first connecting facility of 10
18 side edges of 12 and 14
20 top edges of 12 and 14
22 bottom edges of 12 and 14
24 second connecting facility of 10
26 strip of 14
28 compartment of 14
30 particulate ingredients in 28
32 quickly open allowing means in 18
34 cup
36 sheet of flexible material for 12 and 14
38 plastic for 36
40 foil for 36
42 permanent seal for 16
44 permanent seal for 24
46 heat seal for 42 and 44
48 notch of 32
50 box
52 top flap of 50
54 coffee powder for 30
56 creamer powder for 30
58 sugar for 30
60 sugar substitute for 30

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination of powdered drink multiple compartment flexible packets, each packet for producing a cup of coffee made from a plurality of components contained within said packet when mixed in a liquid, comprising:

a) a rear rectangular panel formed of a sheet of flexible material;

b) a front rectangular panel formed of a sheet of flexible material;

c) means for connecting side edges, top edges and bottom edges of said rear rectangular panel to said front rectangular panel; and d) means for connecting intermediate spaced apart strip of said rectangular panel to said rear rectangular panel in which the strips are in parallel relationships to the top edges and the bottom edges thereof forming a plurality of compartments therein;

e) particulate ingredients in each of said compartments including a serving of coffee powder carried in the first compartment, a serving of creamer powder in a second compartment, a serving of sugar in a third compartment, a second serving of sugar in a fourth compartment, a serving of sugar substitute in a fifth compartment, and a second serving of sugar substitute in a sixth compartment;

f) a plurality of said packets assembled in, and in combination with, a box having a plurality of top flaps which can be opened, whereby said box holds a plurality of said packets which can be removed one at a time to be used to make a cup of coffee; and g) means comprising a notch formed in the side edge and centrally located to one side of each compartment for tearing the compartment and releasing the ingredients from selected compartments of a packet to permit the production of a cup of coffee according to the tastes of the user.

* * * * *